US006968760B2

(12) United States Patent
Hu

(10) Patent No.: US 6,968,760 B2
(45) Date of Patent: Nov. 29, 2005

(54) PRECISION SCREWDRIVER HAVING A TURNING HEAD

(76) Inventor: Cheng-Tsan Hu, No. 205, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 29 days.

(21) Appl. No.: 10/755,270

(22) Filed: Jan. 13, 2004

(65) Prior Publication Data

US 2004/0139832 A1 Jul. 22, 2004

Related U.S. Application Data

(63) Continuation-in-part of application No. 10/215,006, filed on Aug. 9, 2002, now abandoned.

(51) Int. Cl.[7] ..... B25G 3/00
(52) U.S. Cl. ..... 81/490; 81/492; 81/439
(58) Field of Search ..... 81/490, 492, 489, 81/177.4, 437–440

(56) References Cited

U.S. PATENT DOCUMENTS 5,265,504 A * 11/1993 Fruhm ..... 81/439
5,740,706 A * 4/1998 Tseng ..... 81/490
5,749,271 A * 5/1998 Liu ..... 81/60
6,305,815 B1 * 10/2001 Lin ..... 81/490
6,510,768 B2 * 1/2003 Fruhm ..... 81/490
2003/0084759 A1 * 5/2003 Carini ..... 81/492

* cited by examiner

*Primary Examiner*—Debra S Meislin
(74) *Attorney, Agent, or Firm*—Rosenberg, Klein & Lee

(57) ABSTRACT

A precision screwdriver having a turning head includes an accommodation space provided inside a longitudinally extended handle of the precision screwdriver, the accommodation space being open at a wider diameter end of the handle, a holder in the accommodation space, a plurality of ribs each with a locking trough formed in the holder to hold a plurality of tips. A pivot is formed on one end of the holder and an opposing end has a fender formed thereon. The pivot is pivoted to the center of the turning head. A circular protrusion and a groove are provided at where the turning head contacts the accommodation space of the handle with both connected to each other for free pivoting and the turning head functioning as a support axle for the handle. The holder is exposed by pulling the turning head linked to the pivot, and is restricted in the circular trough of the accommodation space by the fender.

3 Claims, 3 Drawing Sheets

PRECISION SCREWDRIVER HAVING A TURNING HEAD

This application is a continuation in part of my application Ser. No. 10/215,006, filed on Aug. 9, 2002, now abandoned.

BACKGROUND OF THE INVENTION (a) Field of the Invention

The present invention is related to a precision screwdriver having a turning head, and more particularly, to one that allows the turning head to achieve agile rotation relatively to the handle of the screwdriver.

(b) Description of the Prior Art

Whereas, a precision screwdriver generally available in the market has its handle fixed or disposed with an interchangeable tip at a smaller end of the handle and is incorporated at another end of the handle with an axially pivoted handle. In use, one has his index finger to hold against the handle at the upper end of the handle and his thumb and another three fingers to hold the handle with the tip aiming at a screw with the handle as an axial to support rotation while rotating the handle by his thumb and other three fingers thus to turn and tighten or loosening the screw depending on the turning direction.

One of the prior art is essentially taking advantage of the space in the body of the handle to be incorporated with a retractable holder to receive and hold multiple exchangeable tips in position. Wherein, the rotation axle required in the use of the precision screwdriver is taken into consideration, and the space inside the handle is open to its end in a wider diameter to place the holder and ribs provided with locking troughs are longitudinally disposed in the middle section of the holder to clamp multiple tips. Both ends of those ribs are connected to define a circular shaft and a fender with the accommodation space in relation to the circular shaft having at its inner edge in the opening end to form protrusion wall and circular protrusion for temporary holding, and the extended end of the circular shaft in relation to the handle is provided to be engaged by a turning cap. Locking rings detachably pivoted to each other are respectively provided inside the cap and the circular shaft so to have the turning head functioning as a support axle for the handle of the screwdriver. By pulling the turning head, the protrusion wall clears away from the circular protrusion thus to consequently pull the holder out of the handle and the holder holds against the circular protrusion by the fender to all the exchange of the tips from the holder.

However, certain insufficiencies are observed from the prior art with their causes summarized as follows:

In use, one has his index finger to press the turning head while using his thumb and middle finger to turn the handle either to tighten up or loosening up the screw. Therefore when the handle rotates in relation to the turning head, the handle will cause the circular shaft to rotate relatively to the turning head. Since the circular shaft is connected to both of the turning head and the handle, a comparatively greater friction is created, resulting in that when the handle rotates in relation to the handle, the circular shaft and the holder at its bottom to turn at the same time. As multiple tips are caught in place on the holder making the total weight very heavy and the use of the screwdriver rather awkward when more strength is required to rotate the handle relative to the rotation by the turning head.

SUMMARY OF THE INVENTION

The primary purpose of the present invention is to provide a precision screwdriver having a turning head to achieve a well-facilitated turning of the handle. To achieve the purpose, an accommodation space is open at a wider diameter end of the handle. A holder is disposed inside the accommodation space and a plurality of ribs each with a locking trough formed in the middle section of the holder to hold a plurality of tips. A pivot is formed on one end of the holder and an opposing end has a fender formed thereon, characterized by that:

the pivot is independently pivoted at the center of the turning head while a circular protrusion and a groove are provided on where the accommodation space of both of the turning head and the handle contacts so that both are connected and allowed to freely pivot. Accordingly, the turning head functions as a support axle for the handle of the screwdriver and when the turning head is pulled, the pivot linked to the turning head pulls out the holder out of the handle and the holder is limited in position by having the fender to hold against the circular groove.

DETAILED DESCRIPTION OF THE PREFERRED EMBODIMENT

Figure 1:
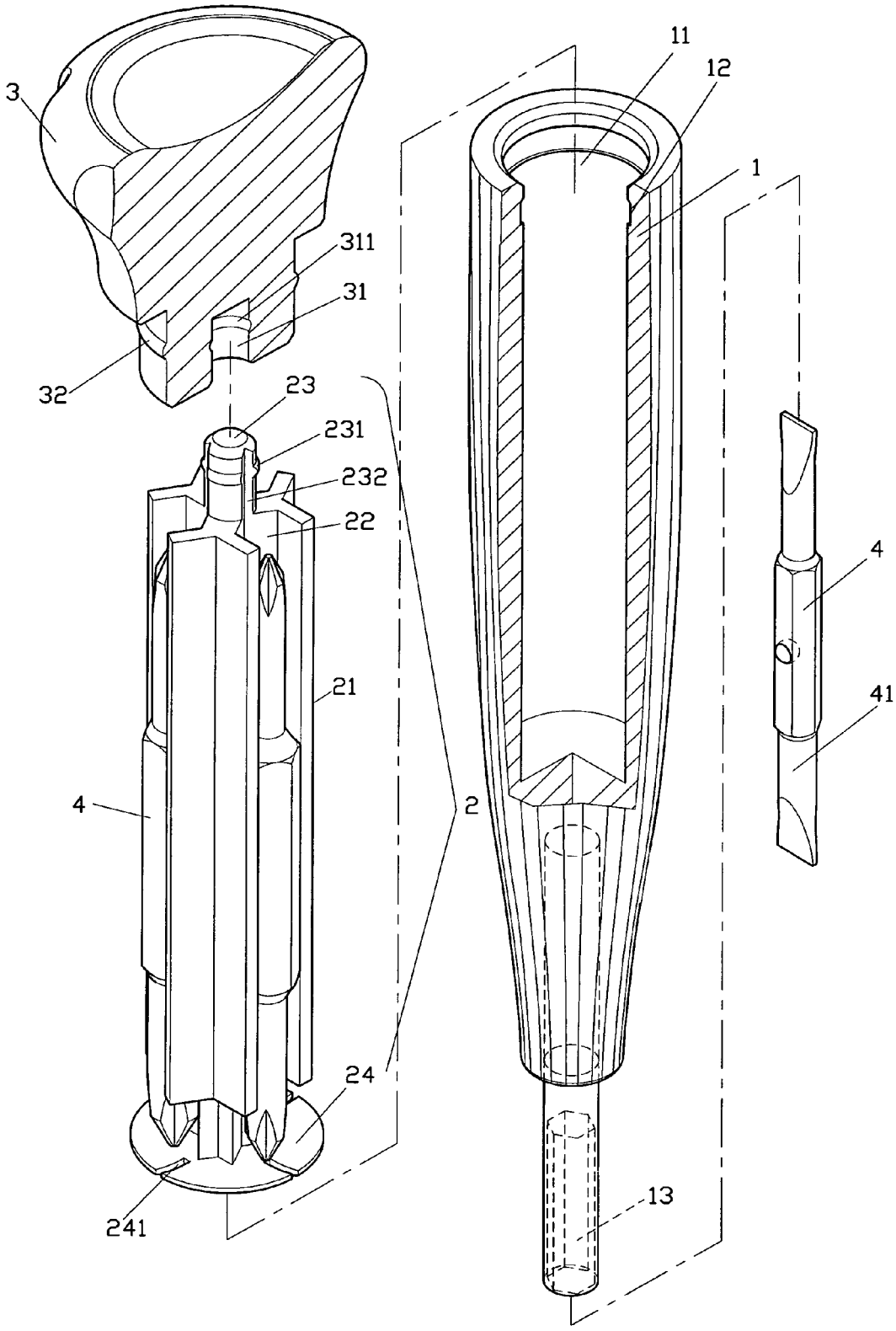
FIG. 1 is an exploded view showing a preferred embodiment of the present invention.

A precision screwdriver having a turning head of the present invention, as shown in FIG. 1, comprises a handle (1), a holder (2), a turning head (3) and tips (4).

The handle (1) comprises an accommodation space (11) being open at a wider diameter, a circular groove (12) within the inner edge of the accommodation space (11). A hexagonal trough (13) is formed within a reduced diameter end of the handle (1) opposing the wider end thereof and is adapted to receive a desired tip (4) therein.

The holder (2) is formed with plastic material integrally with flexibility character. The center portion of the holder (2) is formed with ribs (21) for segregating the space of the holder (2). A plurality of locking troughs (22) are formed on the ribs (21) for storing the tips (4) thereat. Both end of the rib (21) respectively are formed into a pivot (23) and a fender (24) with the outer circumference of the pivot (23) formed a course of protrusion wall (231) and a plurality of slots (232) are provided on the pivot (23) while the fender (24) is in a flexible cone shape. The fender (24) is longitudinally provided with a plurality of gaps (241). The fender (24) is able to shrink when the fender (24) is pressed.

The turning head (3) comprises an insertion hole (31) at the center thereof. The insertion hole (31) comprises a groove (311) in the inner circumference corresponding to the protrusion wall (231) of the pivot (23), for the turning head (3) to engage in a free pivotal status. The turning head (3) further comprises a circular protrusion (32) extending from the outer circumference of the turning head (3) in relation to the circular groove (12) in the inner circumference of the accommodation space (11).

Each tip 4 is in a hexagonal shape with the two ends in a different sizes or types.

Figure 2A:
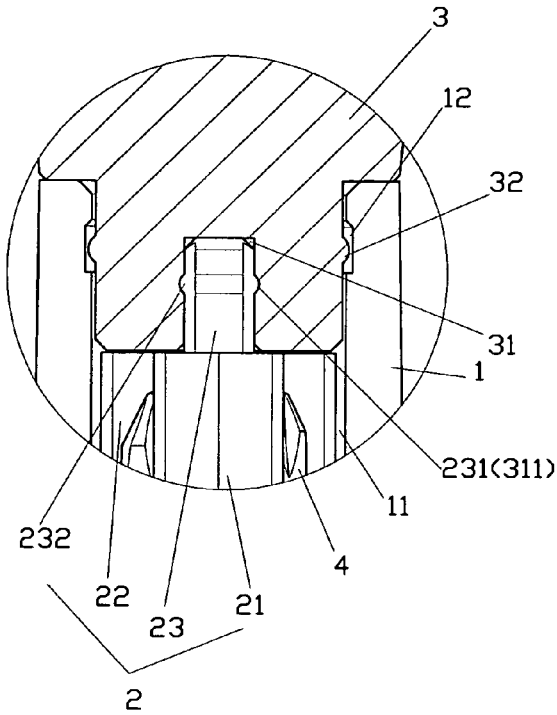
FIG. 2A and FIG. 2B are partially enlarged views of FIG. 2.
Figure 2B:
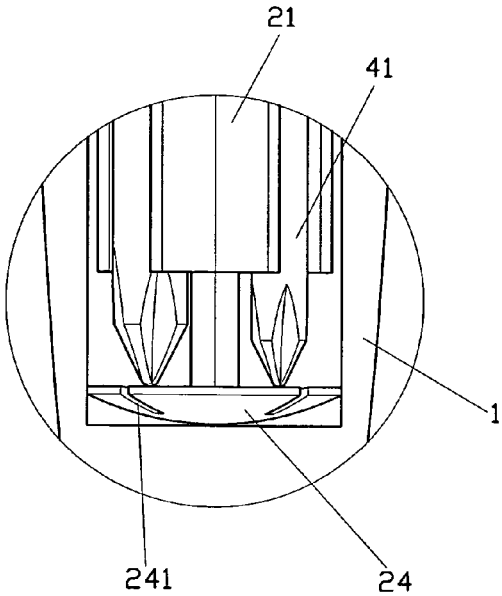
Figure 2:
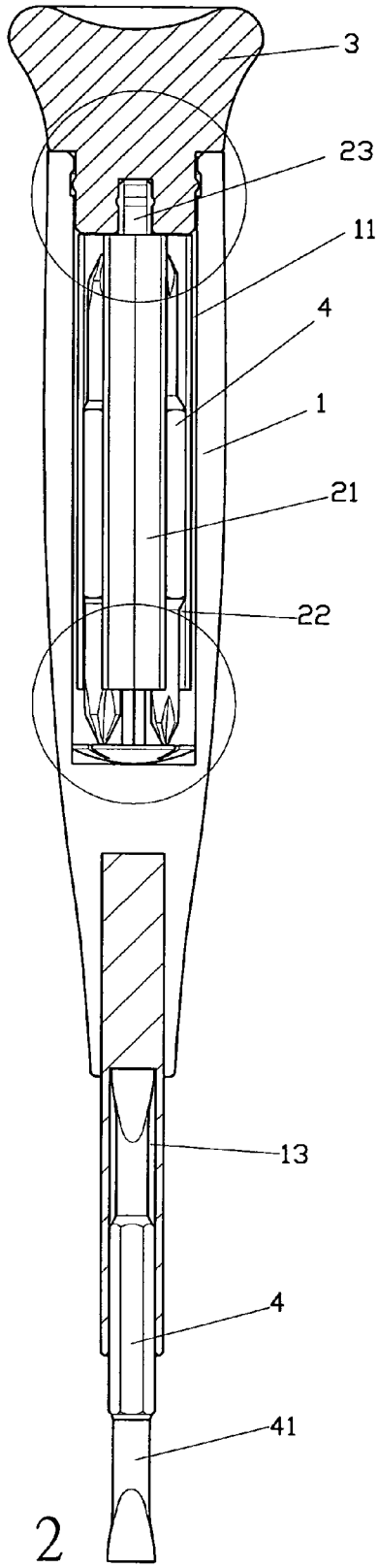
FIG. 2 is a sectional view of the preferred embodiment of the present invention.

As illustrated in FIG. 2, the turning head (3) is inserted in relation to the pivot (23) by means of the insertion hole (31) with the protrusion wall (231) merely inserted and restricted in the groove (311) so that the holder (2) is pivoted to the bottom of the turning head (3), then force is exercised to push in the holder (2) by the fender (24) provided at its lower end along the circular groove (12) at the inner circumference in the open end of the accommodation space (11) of the handle (1). When the fender (24) is pressed, the fender (24) having the gaps (241) is squeezed into the circular groove (12). The tips (4) at this time are pushed into the locking trough (22) on the rib (21) to be held in position. When the holder (2) extends in relation to the accommodation space (11), the fender (24) having the gaps (241) is pushed by force to shrink, so that the fender (24) is able to be placed into the accommodation space 11. Further, the holder (2) is held in position by connecting both of the circular protrusion (32) of the turning head (3) and the circular groove (12) inside the accommodation space (11) so that the holder (2) is concealed in the accommodation space (11). The turning head (2) function as the support axle for turning the handle (1). Since the pivot (23) is independently pivoted at the center of the turning head (3), it does not contact the handle (1). The slots (232) are provided on the circumference of the pivot (23) to significantly reduce the contact area with the insertion hole (31) of the turning head (3). Therefore, upon turning the turning head (3), only the turning head (3) rotates in relation to the pivot (23) while the holder (2) remains being positioned in the accommodation space (11) without moving. Furthermore, the circular groove (12) on the inner circumference of the accommodation space (11) and the circular protrusion (32) from the turning head (3) are loosely adapted to each other. Therefore, once the handle (1) rotates in relation to the turning head (3), only an extremely rotation resistance is met to warrant smooth rotation. In addition, another end of the handle (1) is in reduced diameter, the hexagonal trough (13) is provided to receive the insertion of the tip (4) so to complete a precision screwdriver that contains the spare tips (4) and that allows smooth drive of a selected tip (4) by turning the handle (1).

Figures 3, 3A:
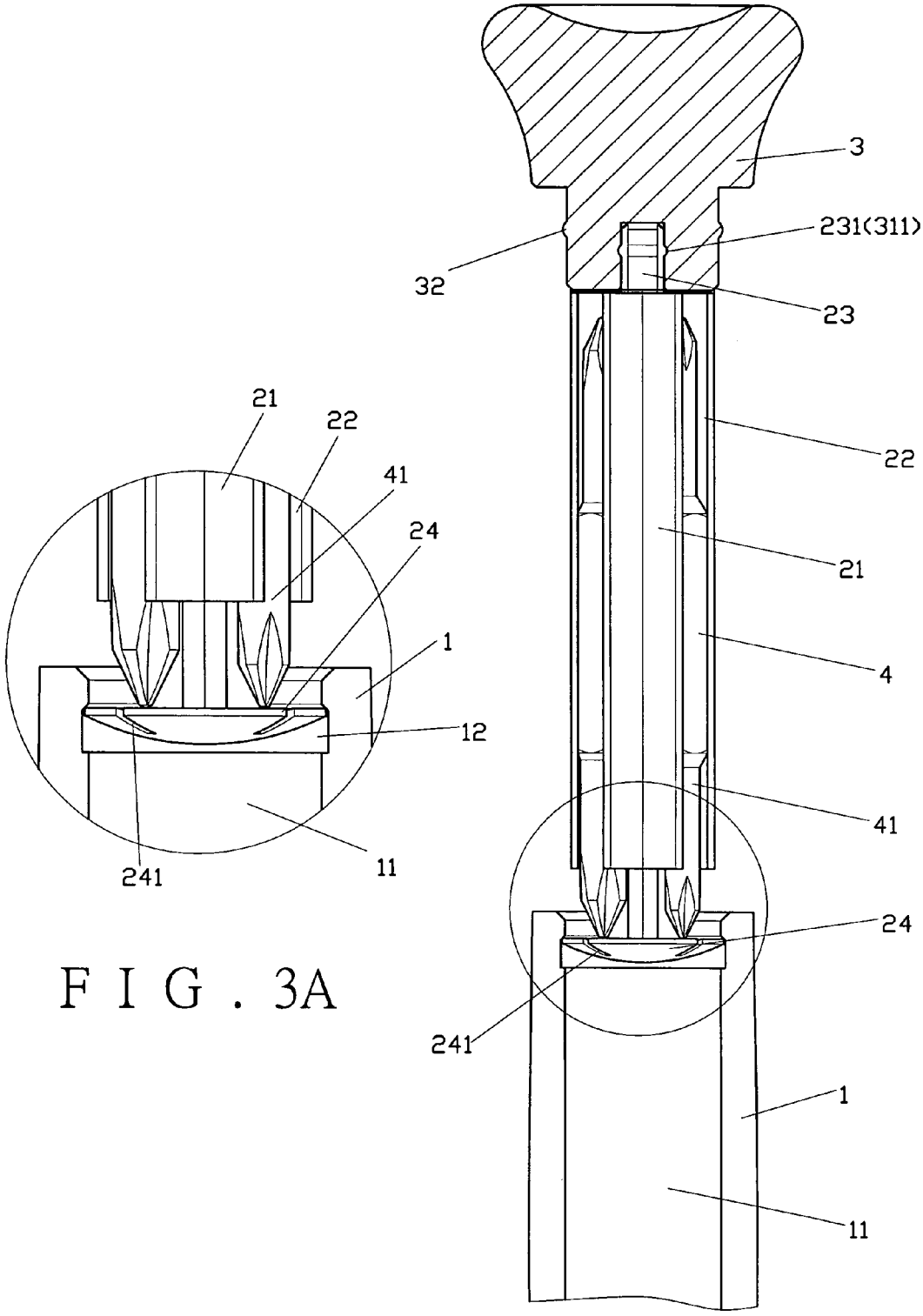
FIG. 3 is a sectional view showing that the holder of the preferred embodiment of the present invention is pulled out.
FIG. 3A is a partially enlarged view of FIG. 3.

Now referring to FIG. 3 when a replacement of another tip (4) is required, the turning head (3) is pulled to move the holder (2) for the circular protrusion (32) to clear away from the circular groove (12) at the inner circumference of the accommodation space (11) in the handle (1). When the holder (2) is fully pulled out, the conical shape of the fender (24) and the gaps (241) allow the fender (24) to be pulled away from the accommodation space (11) and back to the circular groove (12). The fender (24) engages with the circular groove (12) of the handle (1), it is restricted in and prevented from accidental fall out of the accommodation space (11). The tips (4) each held in the locking trough on the rib (21) of the holder (2) are exposed for selection to be exchanged with the existing one inserted in the hexagonal trough (13) in the section of reduced diameter of the handle (1).

I claim:

1. A precision screwdriver having a turning head, essentially comprising an accommodation space provided inside a longitudinally extended handle of the precision screwdriver, the accommodation space being open at a wider diameter end of the handle, a holder in the accommodation space, a plurality of ribs each with a locking trough formed in a middle section of the holder to hold a plurality of tips, a pivot being formed on one end of the holder and an opposing end having a fender formed thereon, characterized by that:

the pivot being pivoted to a central portion of the turning head, a circular protrusion extends from an outer circumference of the turning head in respective correspondence to a circular groove formed in an inner circumference of the accommodation space, both the turning head and the handle being pivotally connected to each other, the turning head functioning as a support axle for the handle, the holder being longitudinally displaced from the accommodation space by pulling the turning head linked to the pivot, and the longitudinal displacement of the holder being limited by releasable engagement of the fender with the circular groove of the accommodation space.

2. The precision screwdriver as claimed in claim 1, wherein, a protrusion wall is provided on a circumference of the pivot, a groove is formed in the turning head in correspondence with the protrusion wall of the pivot; and both of the turning head and the pivot are connected to each other to be freely rotatable.

3. The precision screwdriver as claimed in claim 1, wherein, the fender has a conical shape and provided with gaps to enable a circumference of the fender to be reduced when squeezed by a force.

* * * * *